United States Patent [19]

Seel

[11] 4,165,814

[45] Aug. 28, 1979

[54] CONTAINER FOR POTABLE LIQUID

[76] Inventor: Jerry E. Seel, 595 Meadowbrook Dr., Adrian, Mich. 49221

[21] Appl. No.: 597,296

[22] Filed: Jul. 18, 1975

[51] Int. Cl.[2] ..... B65D 51/24

[52] U.S. Cl. ..... 215/229; 206/806; 215/305; 220/90.2; 220/94 R; 220/212

[58] Field of Search ..... 215/1 C, 1 A, 229, 305, 215/309; 220/90.2, 307, 85, 94 R, 212; 229/7 S; 222/530, 538, 475; 206/806

[56] References Cited

U.S. PATENT DOCUMENTS

| | | | |
|---|---|---|---|
| 1,320,277 | 10/1919 | Schacht | 215/305 |
| 2,052,307 | 8/1936 | Kennedy | 215/1 A |
| 2,264,099 | 11/1941 | Shaw | 215/309 |
| 2,487,274 | 11/1949 | Schaffer | 215/228 |
| 2,597,468 | 5/1952 | Garrett | 222/475 |
| 2,744,661 | 5/1956 | Davis | 222/475 |
| 2,770,399 | 11/1956 | Gross | 222/475 |
| 3,080,088 | 3/1963 | Corrinet | 220/307 |
| 3,349,987 | 10/1967 | Weitzner | 229/7 S |

*Primary Examiner*—Allan N. Shoap
*Attorney, Agent, or Firm*—Gifford, Chandler, VanOphem, Sheridan & Sprinkle

[57] ABSTRACT

A container for a potable liquid in the form of an elongated cylinder provided with two holes in the top thereof. A drinking straw passes from the liquid through one of the holes, forms a loop outside the container, and the outer end of the straw is insertable into the second hole. The straw fits snugly in the two holes in a manner such that the loop can serve as a handle for carrying the container.

3 Claims, 5 Drawing Figures

24
32
16
30
14
20

26
20
16
18
14
10
22
12

24
20
18
14
10

26
28
20
14
10

26
20
16
18
14
24
10
22
12

CONTAINER FOR POTABLE LIQUID

BACKGROUND OF THE INVENTION

Attempts have been made to provide a container for a potable liquid which is provided with a "built-in" drinking straw. Hermes in U.S. Pat. No. 2,815,879; Mainiere in U.S. Pat. No. 2,837,234; and Petriccione in U.S. Pat. No. 2,844,267 each disclose a container wherein a drinking straw is positioned in the container with the suction end of the straw protected by the bottle cap. In each case access to the straw is attained by the removal of the cap or a portion thereof.

I. Field of the Invention

The present invention relates generally to containers for a potable liquid and more particularly to such a container having a cap provided with two holes adapted to receive opposite ends of a flexible straw therethrough.

II. Description of the Prior Art

Kennedy in U.S. Pat. No. 2,052,307 describes a similar container wherein two straws are used. In this case the straws extend through the bottle cap and the ends of the straws are protected by corks or individual caps or closure elements.

Although some convenience may be gained by the type of straw described in the art it is believed the consumer needs additional utility in such structures particularly in their transportation and reuse.

SUMMARY OF THE INVENTION

The present invention is a container for a potable liquid. Although the container can assume any convenient shape or size it is uniquely valuable in the form of an elongated plastic cylinder provided with a cap, the latter having two holes therein. A drinking straw extends from near the bottom of the cylinder upwardly through one of the holes in the cap, then forms a loop, and then passes into the second hole where the outer, or suction, end is stored. When the straw is used for drinking the suction end is pulled out of the second hole.

It is a feature of the invention that when the suction end of the straw is inserted in one of the holes in the top of the container it is not only being kept clean but the loop in the straw can be used as a handle for carrying the container.

BRIEF DESCRIPTION OF THE DRAWINGS

The present invention will be more clearly understood by reference to the following detailed description in conjunction with the attached drawings in which like reference characters refer to like parts throughout the several views and in which.

Figures 1, 2, 3, 4, 5:
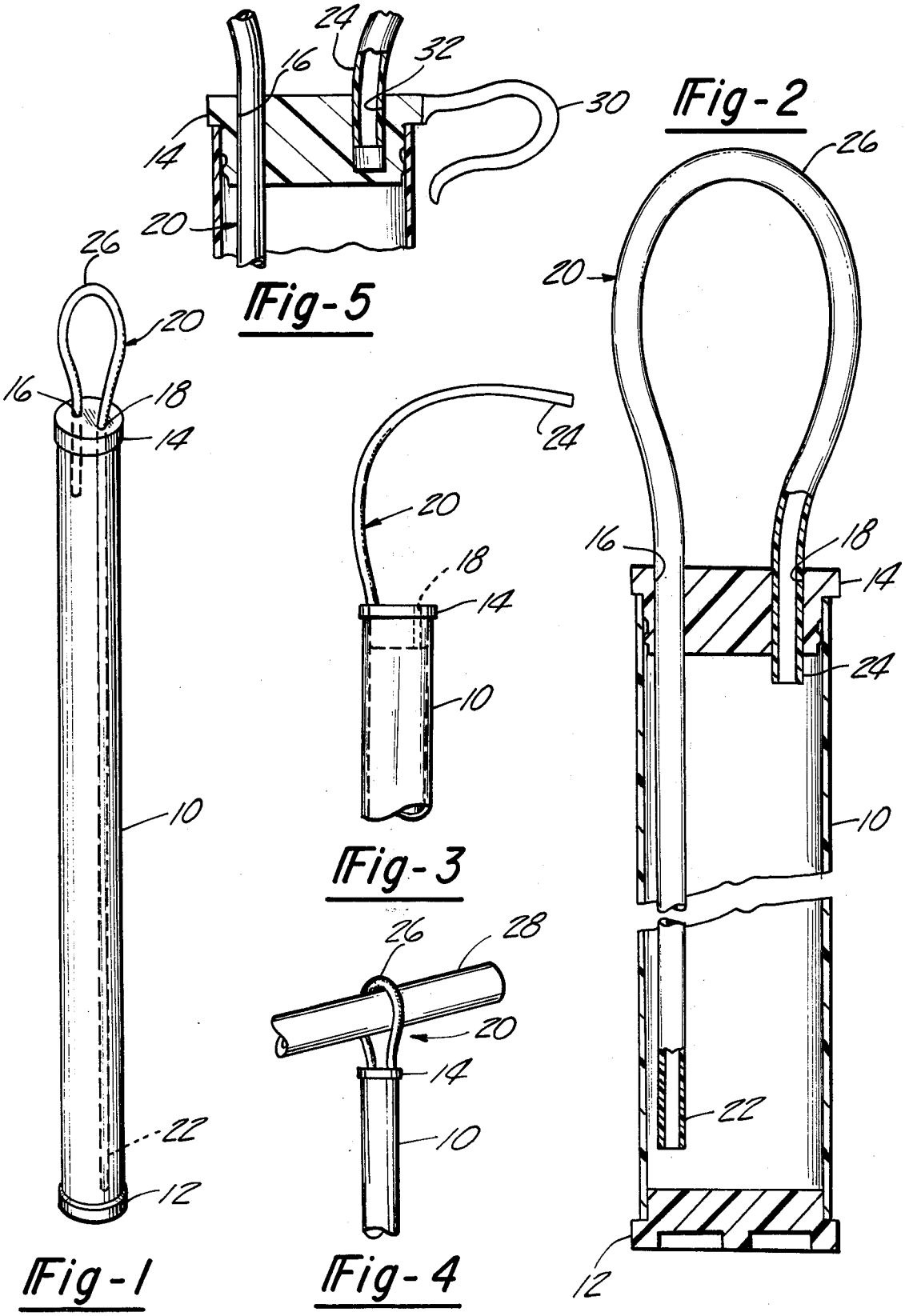
FIG. 1 is a perspective view of a preferred embodiment of the invention.
FIG. 2 is an enlarged view partly in section of the embodiment of FIG. 1 with the straw in its protected position wherein it is suitable for use as a handle.
FIG. 3 is a view of the top portion of the container of the invention with the straw in its position for drinking.
FIG. 4 is a perspective view showing the straw looped around a portion of a bicycle handlebar.
FIG. 5 is a view partly in section of an alternative embodiment of the invention.

Referring particularly to FIGS. 1 and 2, a generally elongated cylindrical container 10 is sealed at its bottom end with bottom plug 12 and is closed at its top end with a snugly held cap 14. The cap 14 is provided with two holes 16 and 18.

A straw indicated generally as 20, is provided with an inner and liquid receiving end 22, an outer and suction end 24, and an intermediate looped portion 26. The straw 20 extends from near the bottom of container 10 upwardly through hole 16 in top 14, forms the loop 26, passes through hole 18, and terminates near the top of container 10.

Referring to FIG. 3, the suction end 24 of the straw 20 is shown pulled out of hole 18 and is in a position where liquid can be easily sucked upwardly through the straw.

Referring to FIG. 4, the loop 26 of straw 20 is shown as looped around a portion 28 of a bicycle handlebar, the loop 26 serving as a handle for carrying or holding the container 10. The handlebar 28 could equally well be a person's arm or neck, a belt or strap, a peg extending from a wall, etc.

FIG. 5 illustrates an alternative embodiment of the invention in which a hook 30 forms an integral part of top cap 14. Hook 30 can serve as an auxiliary holding or carrying means where the container is to be stored for a relatively longer period of time, particularly during extended periods of non-use. FIG. 5 also shows a hole 32 which, in contrast to hole 18, goes only partway through the cap 14.

The straw may be made of any suitable material but preferably is made of an easily extrudable plastic, preferably polyethylene. Because the straw can serve as a handle, and because the straw serves in part as a cover in that it closes the holes in the cap 14, it is important that the straw fit snugly into the holes in the cap. It has been found that this degree of snugness can be easily attained without making the removal of the straw from the hole difficult.

The cap 14 may be made of any suitable material but is preferably made of plastic and can be of the plug type illustrated or can be a snap on, a screw type, or the like. Similarly, the container 10 can also be made of any suitable material but plastic is preferred for light weight, durability, insulating value, adaptability for reuse and ease of forming. A plastic container is also preferred for the reason that it is easily formed with multicolor stripes suggestive of school colors, flags, corporation ads, etc.

The size and shape of the liquid container is not critical. However, an elongated cylinder appears to be uniquely valuable because of its ease of handling and ease of forming. A cylinder with a diameter slightly larger than normal size ice cubes has unique esthetic appeal and is particularly valuable.

I claim:

1. In a container for a potable liquid, the improvement comprising:

a cap closing the top of said container and said cap being provided with a first hole and a second hole each extending completely through said cap, a straw extending through said first hole with a first end positioned adjacent the bottom of said container and said straw having a second end detachably received in said second hole, said straw being removable from said holes whereby said second end of said straw can be removed from said second hole to permit a person to drink the liquid contained within the container through said straw but said straw being constructed of a sufficiently strong material and fitting within said holes with sufficient frictional engagement with said cap to support a container full of potable liquid when the ends of said straw are positioned in said holes so that said straw can be used as a handle to carry said container.

2. A container as defined in claim 1 wherein said container is in the form of an elongated cylinder.

3. A container as defined in claim 1 wherein said cap is provided with an outwardly extending hook integrally formed therewith.

* * * * *